US006110081A

United States Patent [19]

Barrett

[11] Patent Number: 6,110,081

[45] Date of Patent: Aug. 29, 2000

[54] PORTABLE RESISTANCE-BASED EXERCISE APPARATUS

[76] Inventor: Marilyn Barrett, 3130 Veteran Ave., Los Angeles, Calif. 90034

[21] Appl. No.: 09/130,432

[22] Filed: Aug. 6, 1998

[51] Int. Cl.[7] ..... A63B 21/02

[52] U.S. Cl. ..... 482/121; 482/129; 482/142

[58] Field of Search ..... 482/120, 121, 482/102, 142, 129, 140, 49, 50, 72, 123, 124, 126

[56] References Cited

U.S. PATENT DOCUMENTS

| | | | |
|---|---|---|---|
| 2,223,309 | 11/1940 | Swanson | 482/123 |
| 4,391,440 | 7/1983 | Berger | 272/118 |
| 5,176,601 | 1/1993 | Reynolds | 482/123 |
| 5,362,296 | 11/1994 | Wang et al. | 482/123 |
| 5,545,114 | 8/1996 | Gvoich | 482/123 |
| 5,569,138 | 10/1996 | Wang et al. | 482/123 |

*Primary Examiner*—Michael A. Brown
*Assistant Examiner*—Lori Baker
*Attorney, Agent, or Firm*—Rader, Fishman & Grauer PLLC

[57] ABSTRACT

A portable resistance-type exercise apparatus has a hinged, padded platform to support the head and back, a rigid frame including two curved tubes running along either side of the platform, and an elastic cord disposed inside each tube. Each elastic cord has a hand grip for allowing the user to grip the cords securely when doing abdominal exercises. To use the apparatus while doing an abdominal crunch, the user holds onto the hand grips and lifts the torso while pulling the hand grips away from the head and toward the knees at the same time. The obliques can be exercised in a similar manner, by pulling the grip toward the opposite knee while lifting and twisting the torso. The resistance provided by the elastic cords increases the effort required to lift the torso, strengthening the abdominal muscles more quickly than conventional abdominal crunches. The apparatus can also be attached upright to a chair for exercising different muscles in the arms, shoulders and back by changing the direction in which the elastic cords are pulled.

An alternative embodiment of the invention has a U-shaped frame and a supporting cross member, wherein a single elastic member is threaded through the U-shaped frame and a handgrip is attached to each end of the elastic member.

17 Claims, 5 Drawing Sheets

PORTABLE RESISTANCE-BASED EXERCISE APPARATUS

TECHNICAL FIELD

The present invention relates to a portable resistance-based exercise apparatus, and more particularly to a resistance-based exercise apparatus using elastic cords for exercising muscles in the upper body.

BACKGROUND ART

Portable exercise devices have been a popular alternative to health club memberships for many fitness-minded people. The convenience of having an exercise machine in the home allows people to fit exercise into their schedules easily because they are not limited by health club schedules or inclement weather conditions.

One type of machine that has enjoyed increasing popularity is the abdominal exercise machine. Various forms of abdominal exercisers are currently available, the most common being a "rocker-type" apparatus that supports the head and neck while the user does abdominal crunches by raising the torso toward the knees. The rocker device has a generally U-shaped frame with a rocker portion and an armrest portion. A head support underneath the arch of the U-shaped frame cradles the user's head. To use the rocker device, a person lies on the floor on her back, places her head on the head support and her arms on the armrests, and bends her knees to reduce pressure on the lower back. As the user curls the upper body slowly upward toward the knees and back down to the floor, the rocker device moves along with the user to provide continuous support to the head and neck. In essence, the rocker prevents the user from pulling on the head and neck when doing abdominal crunches, minimizing the chances of neck strain from the exercise and requiring the user to focus on using only the abdominal muscles to lift the torso.

Rocker-type abdominal exercise machines, however, are limited because they can only be used to exercise the abdominal muscles and not other muscles in the body. Other types of equipment, such as home gyms, allow a user to exercise more muscle groups, but they tend to be bulky and expensive. Further, when using rocker-type machines or doing conventional sit-ups, the amount of resistance in the exercise is limited by the user's body weight. As a result, it is difficult to increase abdominal strength beyond a certain point without some form of additional resistance.

It is therefore an object of the invention to construct a compact, lightweight exercise device that can be used to exercise muscles in both the abdomen and the arms, shoulders, and back.

It is also an object of the invention to provide an exercise device that can provide additional resistance as the user's strength increases to allow further muscle development.

SUMMARY OF THE INVENTION

Accordingly, the present invention includes two cane-shaped tubes, each tube having a straight portion and a curved top portion, that are connected by at least one and preferably two cross members to form a generally H-shaped frame. Each cane-shaped tube houses an elastic member, such as a bungee cord or spring, which provides added resistance when a user stretches the cord during an exercise. The elastic member itself has a hook on one end for engaging with a pin inside the straight portion of the cane-shaped tube to secure the cord inside the tube. The other end of the elastic member can either be pulled through the curved portion of the cane-shaped tube and attached to a hand grip or coupled with a separate cord attached to the hand grip. The elastic member is removable so that a user can easily switch between elastic members having different resistances, depending on the user's strength and the particular muscle groups to be exercised.

The frame can be used in conjunction with a padded platform for supporting the head, neck and shoulders when the frame is used in abdominal exercises. The platform includes a headrest and a body portion connected together with a hinge so that the headrest can be adjusted from a flat position to an incline position. Curved V-shaped brackets are preferably used to support the headrest in the incline position. When the exercise apparatus is not in use, the brackets can be folded flat against the headrest for compact storage. The bottom surface of the platform is preferably contoured to fit over the cross members such that the platform lies flat on the floor over the tubes without rocking.

In another embodiment of the exercise apparatus, the frame is formed by a U-shaped tubular frame and a cross member between the legs of the U-shaped tube for added rigidity. The distal ends of the U-shaped tube are curved to form cane-shaped legs. An elastic member that is approximately the same length as the U-shaped tube is threaded through the U-shaped tube and out the end of each cane-shaped leg. A handgrip is attached to each end of the elastic member using any known means, such as a hook-and-pin mechanism. This embodiment can be used in the same manner as the preferred embodiment and has the added advantage of having fewer separate parts, making it simpler to manufacture.

DETAILED DESCRIPTION OF THE PREFERRED EMBODIMENTS

Figure 1:
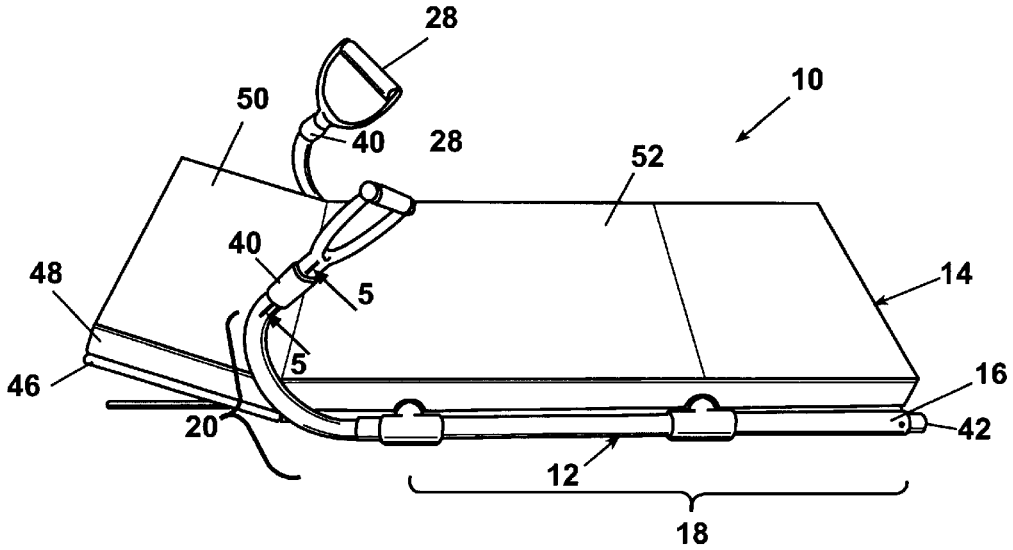
FIG. 1 is a perspective view of the exercise apparatus of the present invention.
Figure 2:
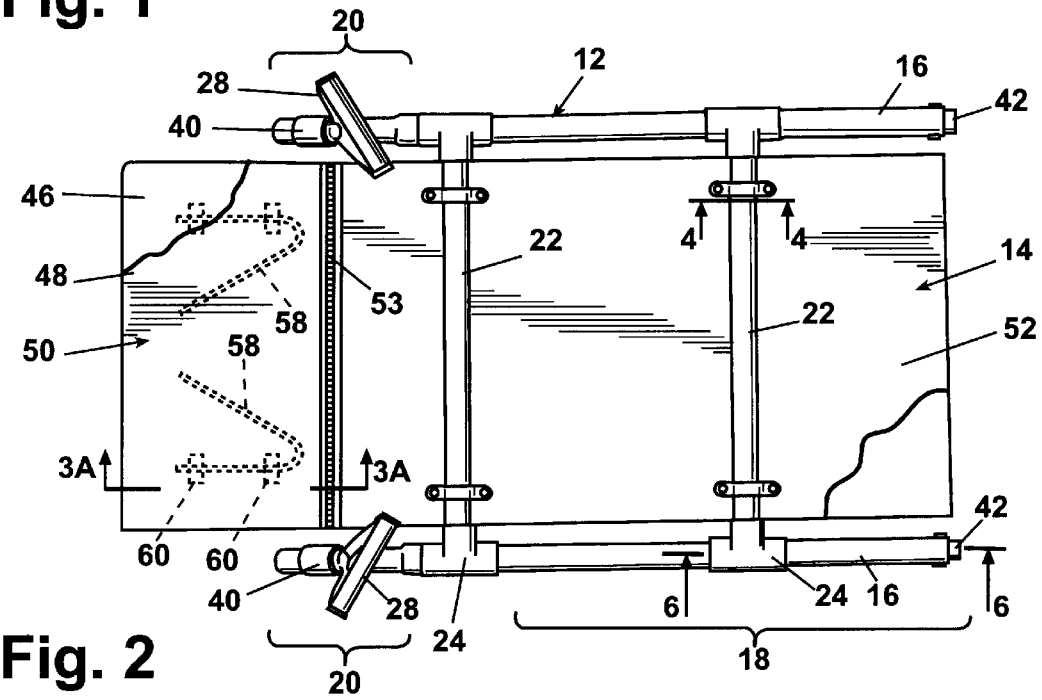
FIG. 2 is a top view of the present invention.

Referring to FIGS. 1 and 2, the exercise apparatus 10 of the present invention includes a generally H-shaped frame 12 and a platform 14. The frame 12 includes two cane-shaped members (tubes 16 in this example), each having a straight portion 18 and a curved portion 20. The tubes 16 are arranged so that the straight portions 18 are substantially parallel to each other and that the curved portions 20 have generally the same orientation. As shown in FIGS. 1 and 2, for example, the curved portions 20 of the tubes 16 are both extending upward from the floor.

At least one, and preferably two cross members (cross tubes 22 in this example) connect the cane-shaped tubes 16 together to form the frame 12. The cross tubes 22 should be arranged to support the frame 12 rigidly to minimize flexing of any of the tubes 16, 22 while the apparatus 10 is being used. As shown in FIG. 2, the cross tubes 22 generally extend at right angles to the straight portions 18 of the cane-shaped tubes 16 to minimize flexing in the frame 12 while the device 10 is in use. However, the cross tubes 22 could also extend at other angles as long as they connect the cane-shaped tubes 16 together into an integral frame 12. Also, cross members can be fashioned from any material in any appropriate shape, tubes 22 being the preferred embodiment. The cross-tubes 22 are connected to the cane-shaped tubes 16 using a T-coupler 24 or similar connection piece. Preferably, the coupler 24 holds the tubes 16 firmly but still allows the tubes 16 to be rotated so that the frame 12 can be folded flat for compact storage, such as under a bed or in a closet. Both the cane-shaped tubes 16 and the connecting cross tubes 22 are preferably made from a rigid lightweight material, such as PVC pipe. The connectors 24 can be made of the same material as the tubes 16, 22 or any other material that is compatible with the pipe material and that can hold the tubes 16, 24 securely.

Alternatively, the cross tubes 22 and cane-shaped tubes 16 can be connected together without using couplers to form the frame 12. For example, if the cane-shaped tubes 16 and the cross tubes 22 are made of PVC pipe, the tubes 16, 22 can be connected together using any known connecting means, such as adhesive or a bracket looped around the cane-shaped tubes 16 and bolted to the cross tubes 22. The tubes 16, 22 could also be made of a suitable metal and welded together in any known manner. The specific manner in which the tubes 16, 22 are connected together is not crucial to the invention as long as the connection holds the tubes 16, 22 securely enough to withstand the forces generated when the apparatus 10 is being used. Using the above-described couplers 24, however, can allow the cane-shaped tubes 16 to be rotated substantially flat when the apparatus 10 is not in use to allow for more compact storage.

Figure 5:
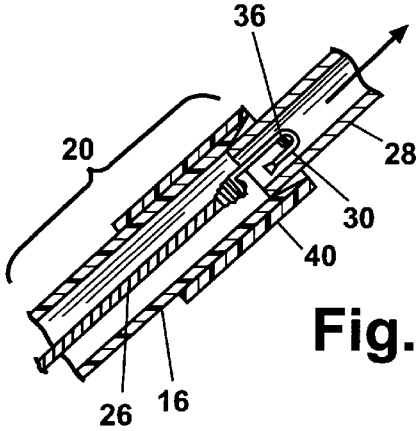
FIG. 5 is a cross sectional view of a curved portion of the tube and hand grip taken along line 5—5 in FIG. 1.
Figure 6:
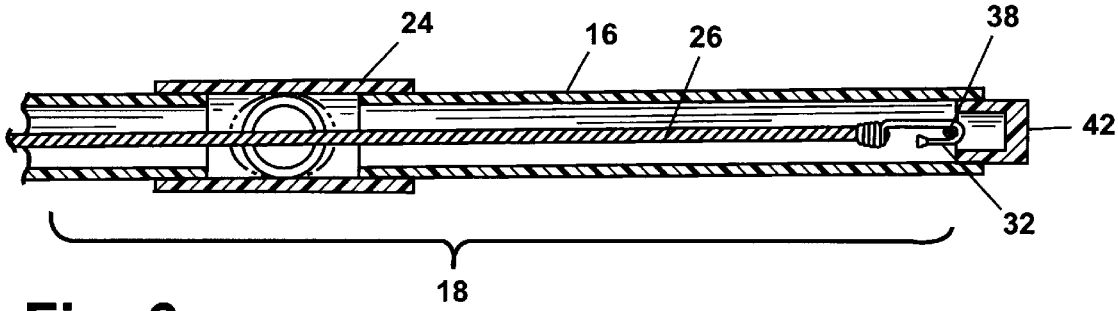
FIG. 6 is a cross-sectional side view of the tube taken along line 6—6 in FIG. 2.

Referring to FIGS. 5 and 6, an elastic member is disposed along the length of the tube 16, exiting from the curved portion 20 of the tube 16 to connect with a hand grip 28. In this example, a heavy elastic cord 26, such as a rubber bungee cord, is used to illustrate the function of the elastic member. However, metal coil springs, metal flex springs, or the like or a combination of springs and cords can also be used to form the elastic member as long as they provide resistance when stretched. For example, a spring that is shorter than the length of the tube 16 can be used as an elastic member by attaching a cord to either end or both ends of the spring and then using the cord to attach the spring to the inside of the tube 16 and to the hand grip 28. The hand grip 28 itself can have any structure as long as it can be held securely by the user even when the elastic cord 26 is under tension. The curved portion 20 helps minimize abrasion of the elastic cord 26 against the edge of the tube 16 and also allows the cord 26 to slide within the tube 16 smoothly as the user pulls on the hand grip 28. In the preferred embodiment, cord 26 resides within tube 16; however, other embodiments are contemplated wherein the cord 26 is attached to an external surface of tube 16, frame 12, or platform 14 and does not reside within tube 16.

In the preferred embodiment, the cord 26 has hooks 30, 32 on each end to secure the cord 26 inside the tube 16 and to the hand grips 28. One hook 30 is for attachment to the hand grip 28, while the other hook 32 is for attachment to the tube 16, preferably near the end of the straight portion 18. In the specific embodiment shown in the figures, the hand grip 28 and the tube 16 each have an associated pin 36 and 38, respectively, for engaging the hooks 30 and 32. The pins 36 and 38 can be integrally formed with the hand grip 28 and tube 16, or they can be manufactured separately and attached inside the hand grip 28 and tube 16 in a later process. The pins 36 and 38 should be strong enough and attached securely enough to withstand the forces generated by the user pulling on the elastic cord 26. The connection between the cord 26 and tube 16 is not limited a hook-and-pin structure, however. The cord 26 can be fixed inside the tube 16 in any manner as long as the connection remains secure under the elastic forces generated when the cord 26 is stretched during use.

To create a more finished appearance for the frame 12, couplers 40 and end caps 42 can be attached respectively to the ends of the curved portion 20 and the straight portion 18 of the tube 16. The couplers 40 and end caps 42 are not essential to practicing the invention, and one of skill in the art would understand that a device excluding these items will not depart from the scope of the invention.

Figure 9:
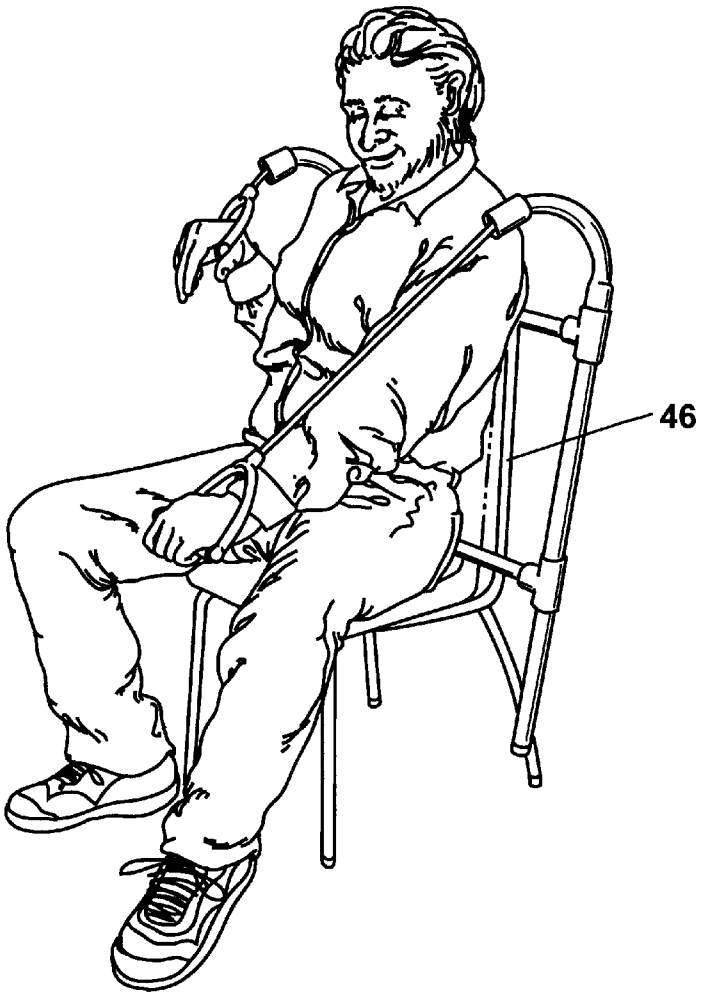
FIG. 9 is a front perspective view of the present invention being used for arm exercises.
Figure 8:
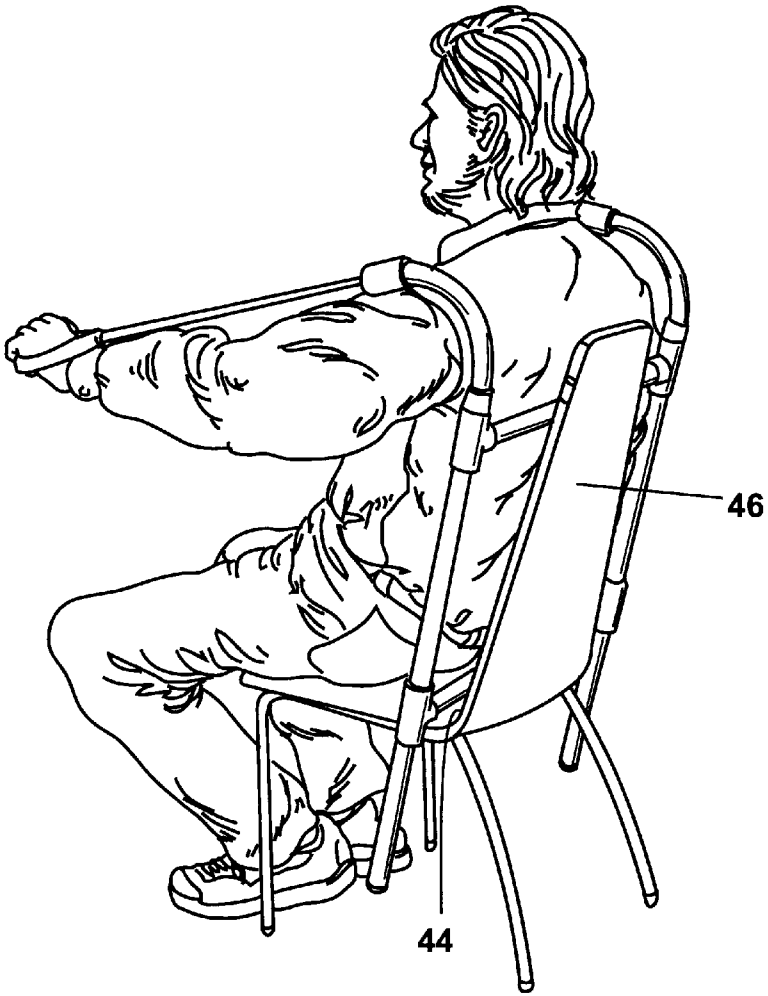
FIG. 8 is a back perspective view of the present invention being used for arm exercises.

As shown in FIGS. 8 and 9, the frame 12 can be used alone for arm exercises by propping one of the cross tubes 22 on a chair seat 44. The cross tubes 22 rest against a chair back so that the user's back holds the frame 12 in place while doing arm exercises. For abdominal exercises, however, the platform 14 is usually needed to cushion the user's back from the cross tubes 22.

Figure 3A:
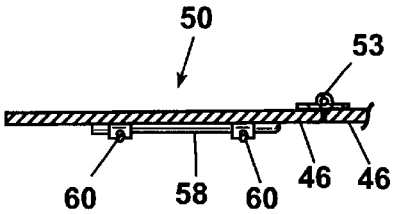
FIG. 3*a* illustrates a headrest portion of a platform in the present invention as taken from line 3A—3A in FIG. 2.
Figure 3B:
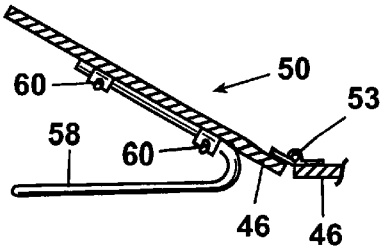
FIG. 3*b* illustrates the headrest of the present invention in an incline position.
Figure 4:
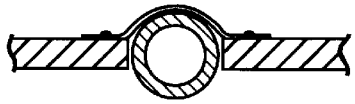
FIG. 4 is a cross-sectional side view of a recessed portion of the platform and a cross-tube fitting in the recessed portion taken along line 4—4 in FIG. 2.

Referring to FIGS. 1–4, the platform 14 preferably has a rigid layer 46 for stability and a padded layer 48 for the user's comfort. FIGS. 2 through 4 show the platform 14 with the padded layer removed for clarity. The rigid layer 46 is divided into a headrest 50 and a body portion 52 so that the platform 14 can be adjusted to provide additional support to the head and neck during abdominal exercises. The rigid layer 46 can be made of any material that will hold its general shape under the user's body weight, such as plywood. Further, the headrest 50 and body portion 52 can be made from different materials to provide varying degrees of support. A hinge 53 connects the headrest 50 and the body portion 52, allowing the headrest 50 to be arranged at different angles relative to the body portion 52. The width of the platform 14 should be less than the distance between the straight portions 18 of the tubes 16 so that the platform 14 can fit easily in between the two tubes 16.

As shown in FIGS. 1 and 4, the body portion 52 of the rigid layer 46 preferably contains contours to fit over the cross tubes 22 so that the bottom surfaces of the body portion 52 and the cross tubes 22 are generally flush with each other. This allows the frame 12 and platform 14 to lie flat on the floor without rocking. One possible method of constructing this contour 54 is shown in greater detail in FIG. 4. In this example, the rigid layer 46 is separated into sections that are then joined together in a spaced relationship with a curved plate 56 over the space. The curved plate 56 is contoured to fit over the circumference of the cross tube 22 for maximum stability of the platform 14. Other ways of creating the contour 54 include, but are not limited to, molding or cutting the rigid layer 46 to fit over the cross tubes 22.

As noted above, the headrest 50 can be positioned in either a flat position or an inclined position, as shown in FIGS. 3A and 3B. To hold the headrest 50 in position, a bracket or brackets 58 can be connected to the headrest's bottom surface. The brackets 58 are preferably V-shaped brackets that can pivot between a folded position, as shown in FIG. 3A, and an open position, as shown in FIG. 3B. The V-shaped brackets 58 are attached to the headrest 50 with bracket hinges 60 that hold the brackets 58 securely to the headrest 50 but still allow the brackets 58 to rotate freely within the hinge 60. However, any known bracket that can fold flat against the headrest can be used.

Figure 7:
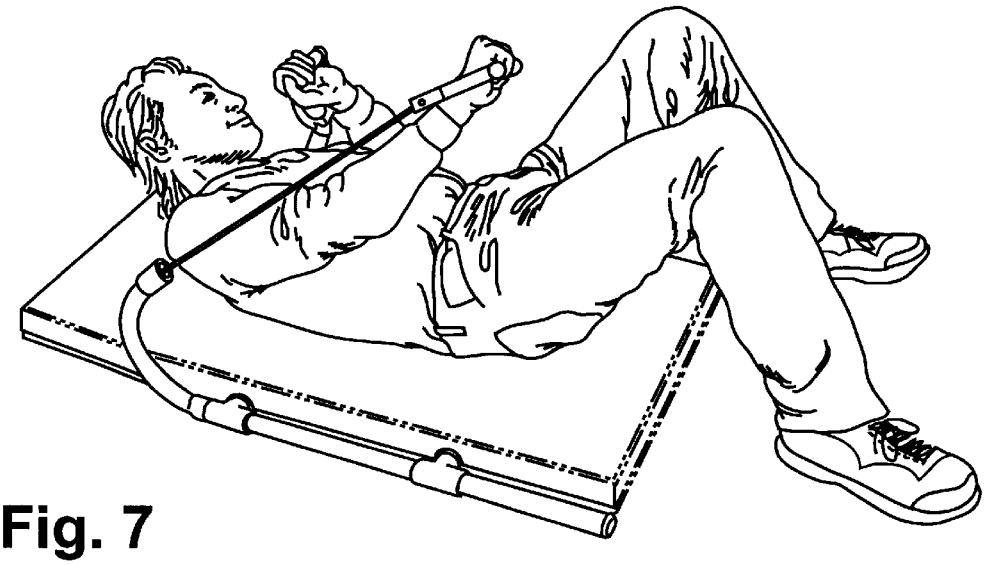
FIG. 7 is a perspective view of the present invention being used for abdominal exercises.

FIGS. 7 through 9 illustrate how the present invention is used to exercise upper body muscles, such as muscles in the shoulders, arms and back. To exercise the abdominal muscles, as shown in FIG. 7, the user lies with his back flat against the body portion 52 of the platform 14. The knees are preferably bent to reduce strain in the lower back muscles when exercising the abdominal muscles. If desired, the user can unfold the V-shaped brackets 58 to raise the headrest 50 into an inclined position. The user then grips one cord 26 in each hand via the hand grips 28 and raises the torso toward the knees in an abdominal crunch, pulling the hand grips 28 toward the knees as well to stretch the cords 26. The resistance provided by the cords 26 tends to pull the upper body back toward the platform 14, requiring the user to exert greater muscle force in the abdominal area to overcome the resistance and raise the torso. To exercise the oblique muscles on each side of the abdomen, the user raises and twists the torso while pulling one hand grip 28 across the body toward the opposite knee. Here, the resistance from the cord 26 tends to pull the body back down at an angle, requiring the user to exert greater force using the oblique muscles to counteract the resistance.

The device 10 can also be used to exercise the muscles in the arms and upper back by fitting the frame 12 over a chair so that the curved portions 20 of the cane shaped tubes 16 are over or near the user's shoulders, as shown in FIGS. 8 and 9. For added stability, the frame 12 can be secured to the chair with adjustable straps or ties (not shown), such as cloth strips hook and loop tape, such as VELCRO. The user can then pull on the hand grips 28 in different directions while sitting in the chair to exercise different muscles in the arms and upper back. For example, the exercise shown in FIGS. 8 and 9 works the tricep muscles as the user pulls forward on the hand grips 28 away from the body. The user can either pull on the hand grips 28 one at a time or simultaneously. To change the effort required to stretch the cord 26, the user can use a thicker or thinner elastic cord 26 to raise or lower the resistance, respectively. For a greater range of resistances, the device 10 can be modified to allow more than one cord 26 to be attached inside each tube 16. For example, the tubes' 16 diameter can be increased to accommodate extra cords, and reinforced pins 36, 38 can be constructed to withstand the increased stress created by pulling on the extra cords. Thus, the present invention can still challenge the user even as he or she gains increased muscle strength. After completing the workout, the user can rotate the tubes 16 and the brackets 58 so that the device 10 has a substantially flat profile, allowing for easy storage in a closet or underneath a bed.

Figure 10:
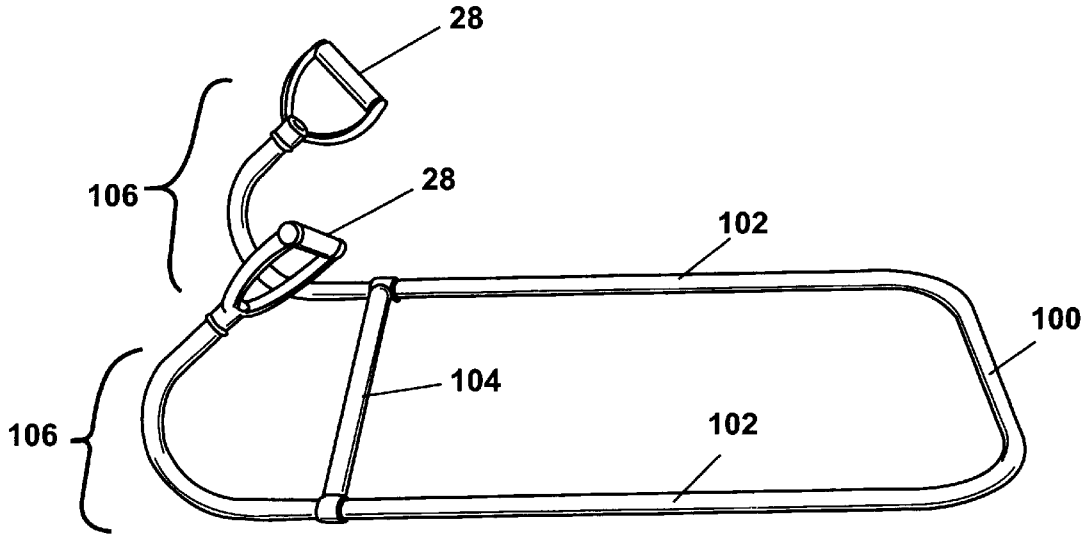
FIG. 10 is a perspective view of a second embodiment of the present invention.
Figure 11:
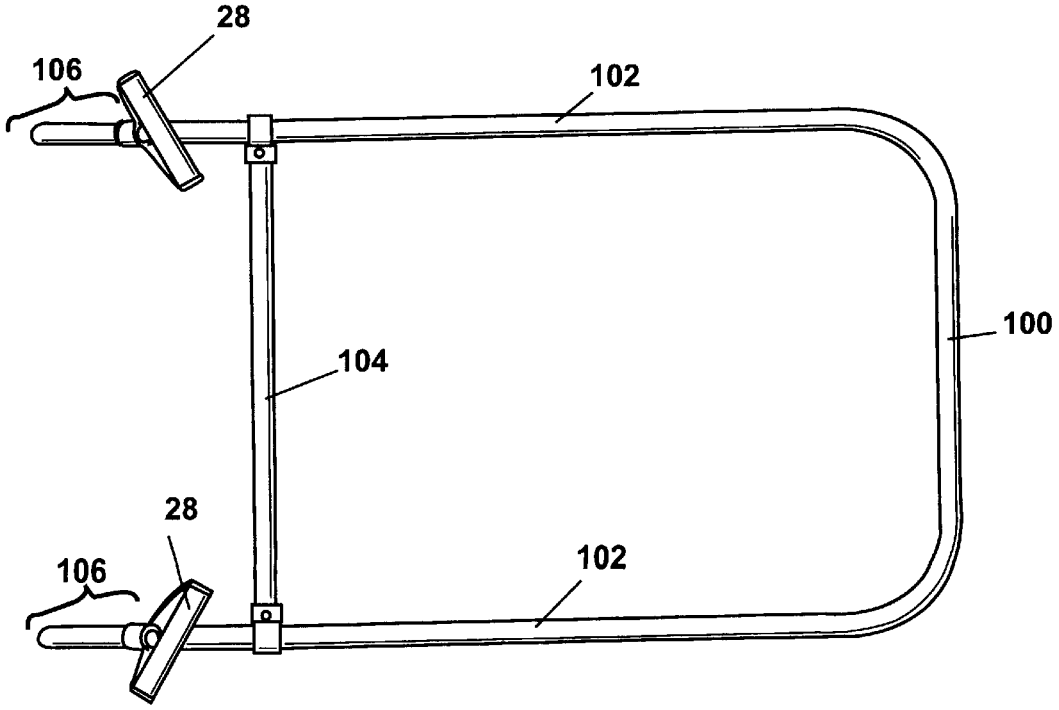
FIG. 11 is a top view of the embodiment shown in FIG. 10.
Figure 12:
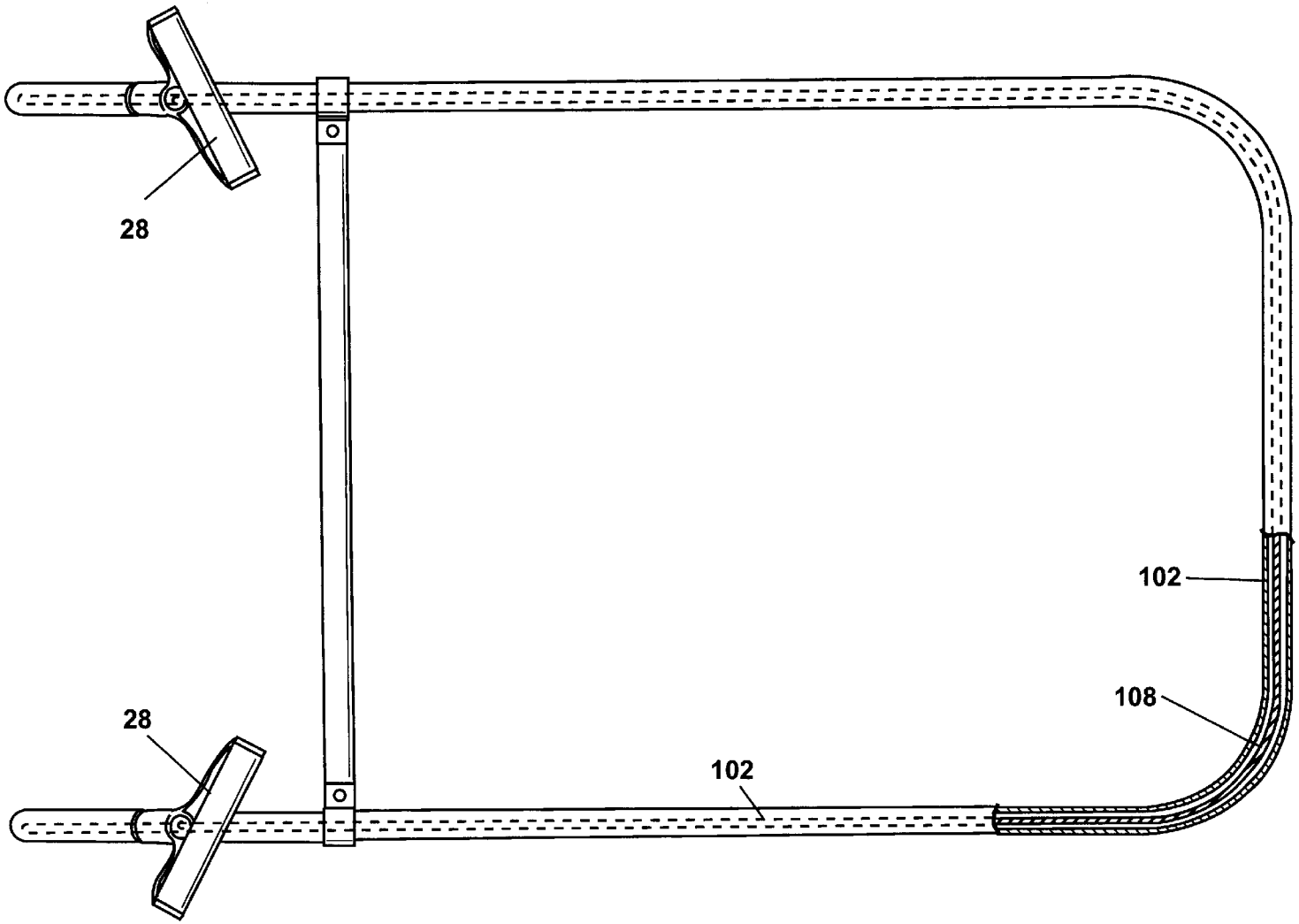
FIG. 12 is a cutaway view of the embodiment shown in FIGS. 10 and 11.

A second embodiment of the present invention is shown in FIGS. 10, 11 and 12. This embodiment is used in the same general manner as the first embodiment shown and described above, but has a somewhat simpler structure. The second embodiment includes a U-shaped tubular frame 100 having two integrally formed legs 102 and a cross tube 104 whose ends are connected to each of the legs 102 and disposed across the U-shaped frame 100. The legs 102 of the U-shaped frame 100 each have a cane-shaped portion 106. A handgrip 28 extends from the end of each cane-shaped portion, similar to the apparatus of the first embodiment.

Referring to the cutaway view shown in FIG. 12, an elastic 108 is disposed inside the U-shaped frame 100, and each end of the elastic member 108 is connected to the hand grip 28 in any manner that can withstand the forces generated when the elastic member 108 is stretched during use, such as a hook-and-pin structure. Like the elastic member in the first embodiment, the elastic member 108 in the present embodiment can be a bungee cord, metal coil springs, metal flex springs, or the like or a combination of springs and cords. As in the first embodiment, the elastic member 108 in the second embodiment should provide sufficient resistance when stretched to promote muscle development. However, the elastic member 108 in the present embodiment can be one continuous piece because the U-shaped frame 100, including the two legs 102, is one continuous tube. This embodiment can be used in the same manner as the first embodiment described above, either with or without a platform and either on the floor or attached to a chair. The embodiment shown in FIGS. 10–12 also has the added advantage of having fewer parts and connections than the first embodiment, making the second embodiment easy and economical to produce.

It should be understood that various alternatives to the embodiments of the invention described herein may be employed in practicing the invention. It is intended that the following claims define the scope of the invention and that the methods and apparatus within the scope of these claims and their equivalents be covered thereby.

What is claimed is:

1. An exercise apparatus, comprising:

a pair of tubes, each tube corresponding to right and left sides, respectively, of a person's body and having a straight portion and a curved portion, the tubes being disposed such that the straight portions of said tubes are substantially parallel to each other and such that the curved portions have substantially the same orientation;

at least one cross member disposed in between said pair of tubes, said pair of tubes and said at least one cross member being connected together in a non-pivotable manner to form a rigid frame;

at least one pair of elastic members, each member disposed inside one of said pair of tubes;

means for fixing each of said elastic members into each of said tubes, wherein each tube contains at least one elastic member;

a pair of hand grips, each hand grip coupled with one of said pair of elastic members, wherein the hand grips extend from the curved portion of each of said tubes when said elastic members are in an unstretched state.

2. The apparatus of claim 1, wherein said at least one cross member is perpendicular to said pair of tubes such that said at least one cross member and said pair of tubes form a generally H-shaped rigid frame.

3. The apparatus of claim 1, wherein said elastic members are elastic cords, and wherein said fixing means comprises:

a hook at each end of said elastic cord; and a pin inside the straight portion of each tube, wherein one of said hooks on said elastic cord engages with said pin to hold said one end of said elastic cord to said tube.

4. The apparatus of claim 1, wherein said elastic member is a spring, and wherein said fixing means comprises:

a hook portion at each end of said spring;

a pin inside said tube, wherein one of said hook portions on said spring is coupled with said pin and wherein the other of said hook portions is coupled with said hand grip.

5. The apparatus of claim 4, wherein one of said hook portions on said spring engages with said pin and wherein the other of said hook portions connects to said hand grip.

6. The apparatus of claim 4, wherein one of said hook portions on said spring engages with said pin and wherein the other of said hook portions is connected to a cord attached to said hand grip to couple said spring with said hand grip.

7. The apparatus of claim 4, wherein one of said hook portions on said spring engages with said hand grip and wherein the other of said hook portions is connected to a cord attached to said pin to couple said spring with said pin.

8. The apparatus of claim 4, further comprising two cords attached to each of said springs, one cord attached to each of said hook portions on said spring, and wherein one of said cords is attached to said pin and the other of said cords is attached to said hand grip to couple said spring with said hand grip and said pin.

9. The apparatus of claim 1, wherein each of said tubes is pivotable such that said curved portions of said tubes and said cross member lie substantially in the same plane.

10. The apparatus of claim 1, further comprising a platform having:

a headrest;

a body portion, said body portion having at least one contour that fits over said cross member;

a padding layer covering at least one surface of said headrest and said body portion; and a hinge connecting said headrest portion and said body portion.

11. The apparatus of claim 10, further comprising a support bracket connected to a bottom surface of said headrest, wherein said support bracket is moveable between a first position for supporting said headrest in an incline position relative to said body portion and a second position that positions said support bracket substantially flat against said headrest portion such that said headrest and said body portion of the platform are substantially in the same plane.

12. The apparatus of claim 11, wherein said support bracket comprises two V-shaped brackets, each V-shaped bracket having two legs, and wherein one of said legs in each V-shaped bracket is pivotably connected to the bottom surface of said headrest to position said bracket in either the first position or the second position.

13. An exercise apparatus, comprising:

a pair of tubes, each tube corresponding to right and left sides, respectively, of a person's body and having a straight portion and a curved portion, the tubes being disposed such that the straight portions of said tubes are substantially parallel to each other and such that the curved portions have the same orientation;

at least two cross members disposed in between and perpendicular to said pair of tubes, said pair of tubes and said at least two cross members being connected together in a non-pivotable manner to form a generally H-shaped rigid frame;

at least one pair of elastic cords, each elastic cord having a hook at each end of said elastic cord;

a pin inside the straight portion of each tube, wherein one of said hooks on said elastic cord engages with said pin to hold said one end of said elastic cord to said tube;

a pair of hand grips, each hand grip coupled with at least one of said pair of elastic members, wherein the hand grips extend from the curved portion of each of said tubes when said elastic cords are in an unstretched state;

a platform disposed underneath said frame, said platform having:

a headrest;

a body portion, said body portion having at least two contours that fit over said cross members;

a hinge connecting said headrest portion and said body portion;

a padding layer covering at least one surface of said headrest and said body portion; and a support bracket connected to a bottom surface of said headrest, wherein said support bracket is moveable between a first position for supporting said headrest in an incline position relative to said body portion and a second position that positions said support bracket substantially flat against said headrest portion such that said headrest and said body portion of the platform are substantially in the same plane.

14. The apparatus of claim 13, further comprising at least two elastic cords in each of said tubes, each of said elastic cords having one end engaged with said pin in said tube and the other end engaged with said hand grip.

15. The apparatus of claim 13, wherein said support bracket comprises two V-shaped brackets, each V-shaped bracket having two legs, and wherein one of said legs in each V-shaped bracket is pivotably connected to the bottom surface of said headrest to position said bracket in either the first position or the second position.

16. The apparatus of claim 13, wherein each of said tubes is pivotable such that said curved portions of said tubes and said cross members lie substantially in the same plane.

17. An exercise apparatus, comprising:

a U-shaped tube having right and left legs corresponding to right and left sides, respectively, of a person's body, each leg having a straight portion and a curved portion, wherein the straight portions are disposed such that they are substantially parallel to each other and such that the curved portions have substantially the same orientation;

at least one cross member disposed in between said two legs, said U-shaped tube and said cross member being connected together to form a frame;

an elastic member disposed inside said U-shaped tube;

a pair of hand grips, each hand grip coupled with one end of said elastic member, wherein the hand grips extend from the curved portion of each leg of said U-shaped tube when said elastic member is in an unstretched state.

* * * * *